United States Patent [19]

Cheng et al.

[11] 4,082,220

[45] Apr. 4, 1978

[54] MODEL ROADWAY TRACK CONSTRUCTION

[75] Inventors: Richard C. M. Cheng, Mantua; Gene Patrick Dennis, Glassboro, both of N.J.; Robert M. Stewart, Langhorne, Pa.

[73] Assignee: Tyco Industries, Inc., Moorestown, N.J.

[21] Appl. No.: 701,258

[22] Filed: Jun. 30, 1976

[51] Int. Cl.[2] ..... A63H 19/30

[52] U.S. Cl. ..... 238/10 F; 46/1 K; 238/10 C

[58] Field of Search ..... 46/1 K; 104/53, 60, 104/147 A; 29/453; 238/10 R, 10 A–10 F; 339/20, 21, 22 R, 66 R, 66 M, 75 M, 75 MP, 91 R, 61 R, 61 C, 61 LM, 252 R

[56] References Cited

U.S. PATENT DOCUMENTS

| | | | |
|---|---|---|---|
| 2,143,195 | 1/1939 | Kahn et al. | 238/10 C |
| 2,232,511 | 2/1941 | Caruso | 238/10 C |
| 2,272,903 | 2/1942 | Bonanno | 238/10 C |
| 2,647,693 | 8/1953 | Carver | 238/6 |
| 3,140,825 | 7/1964 | Edmondson | 238/10 F |
| 3,409,858 | 11/1968 | Krehbiel | 339/91 R |
| 3,830,426 | 8/1974 | Martin | 238/10 F |

FOREIGN PATENT DOCUMENTS

| | | | |
|---|---|---|---|
| 154,129 | 11/1953 | Australia | 238/10 |
| 2,253,735 | 5/1973 | Germany | 339/75 MP |

*Primary Examiner*—Drayton E. Hoffman
*Assistant Examiner*—Carl Rowold
*Attorney, Agent, or Firm*—Seidel, Gonda & Goldhammer

[57] ABSTRACT

A sectional track construction wherein each section constitutes a generally flat body having at least one longitudinally extending conductor exposed upwardly and provided with end portions each extending beyond the adjacent lateral body portion on one side of the conductor, and an oblique cam at each end of the section for engagement with a like cam of a like section to urge the exposed conductor end portions into side-by-side facing engagement with conductor end portions of a like track section.

19 Claims, 5 Drawing Figures

FIG. 1
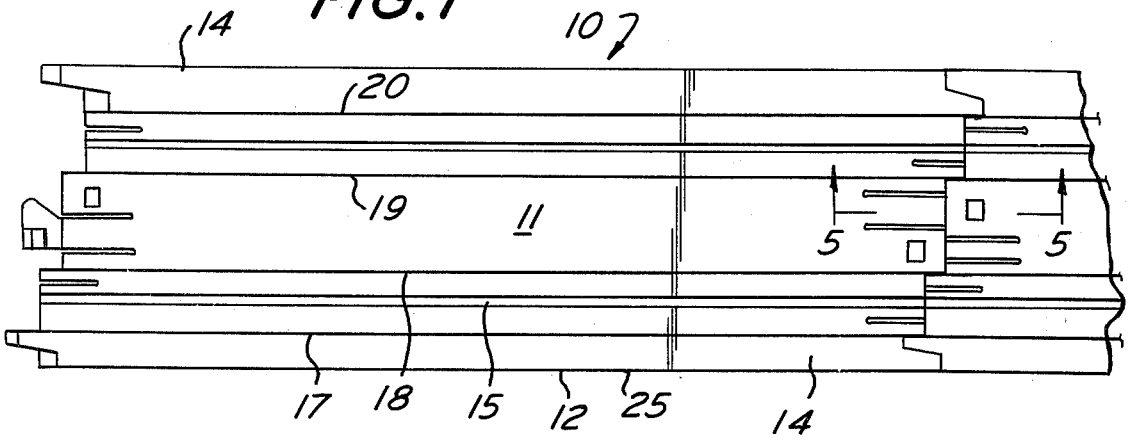
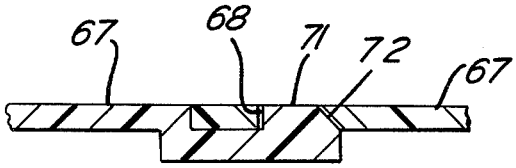
FIG. 5
FIG. 4
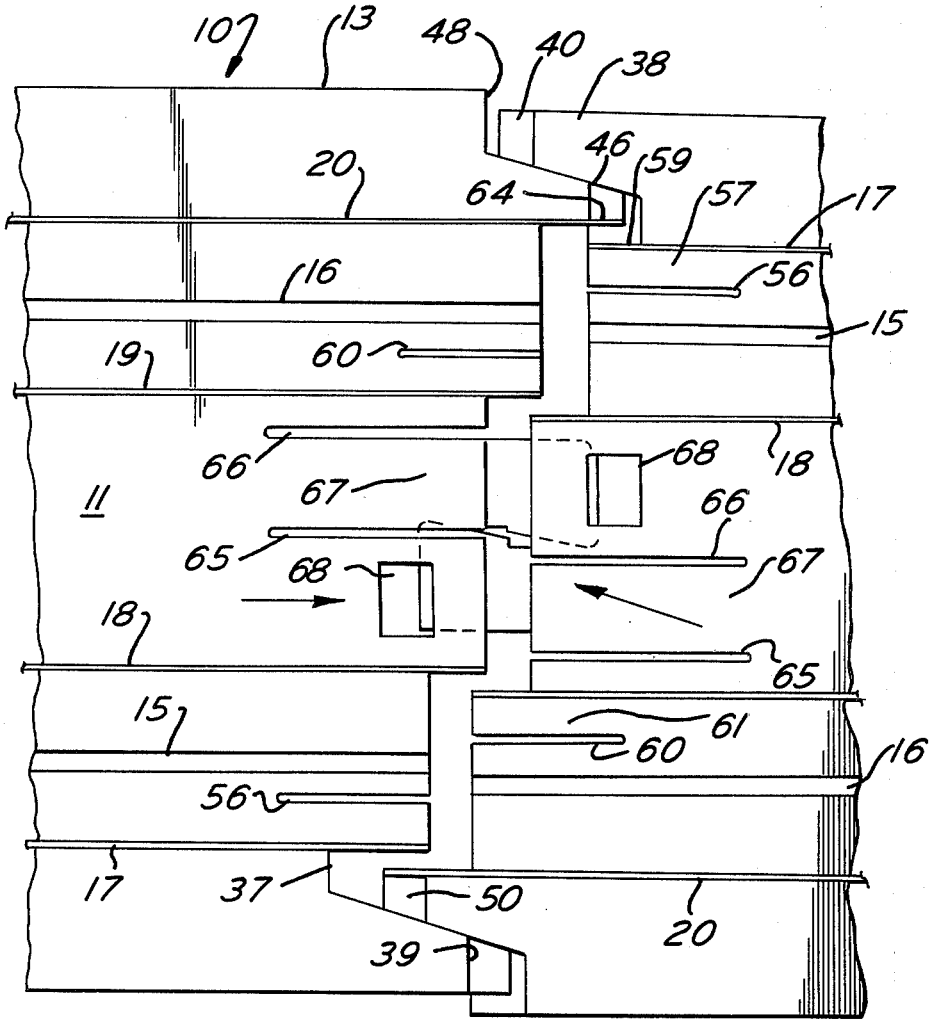

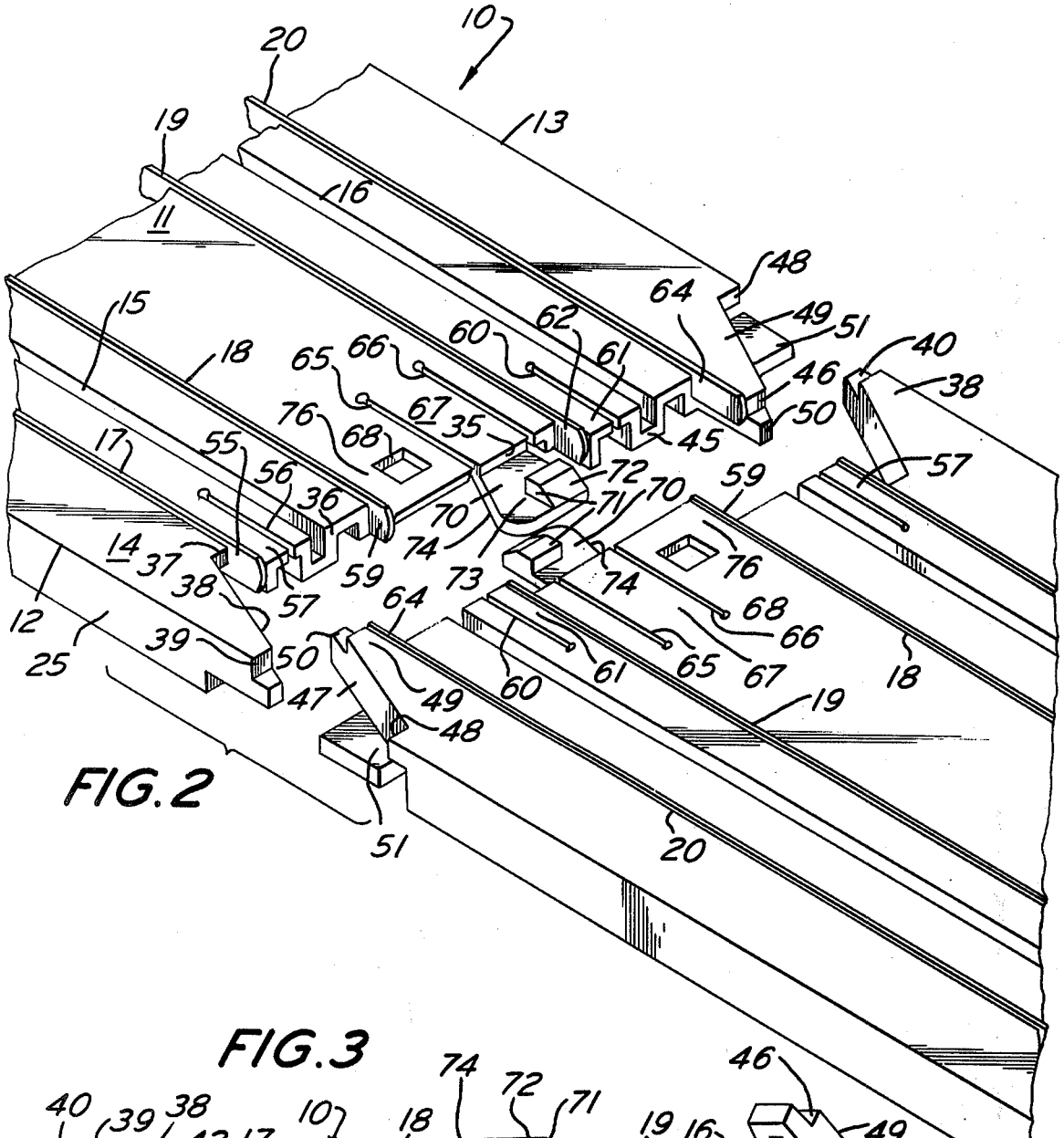
FIG. 2
FIG. 3
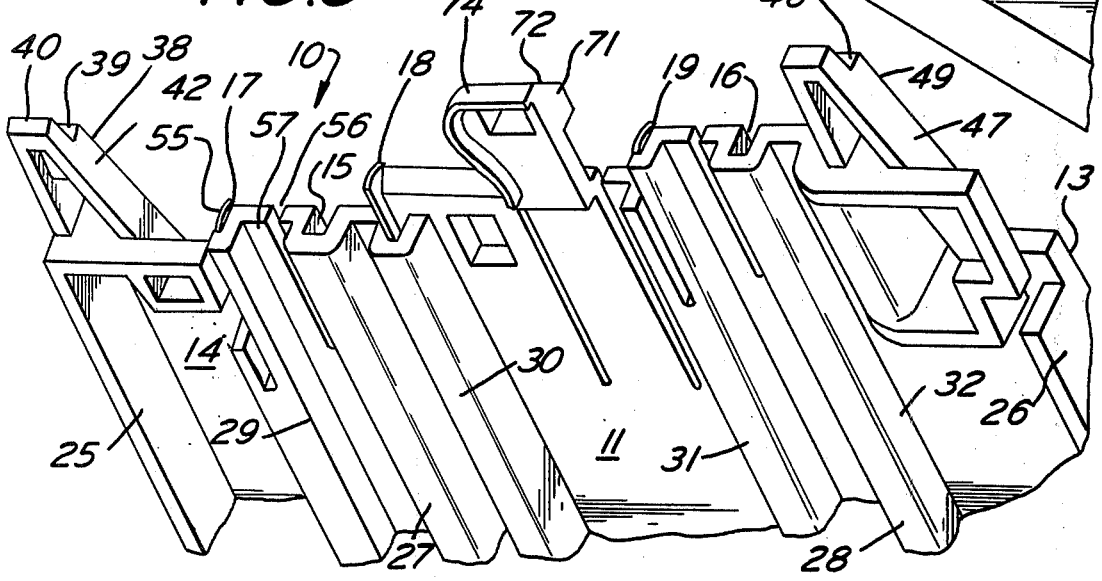

MODEL ROADWAY TRACK CONSTRUCTION

BACKGROUND OF THE INVENTION

As is well known to those versed in the art of model vehicles and track, there have heretofore been provided a wide variety of model vehicle track constructions which have achieved popular usage, but subject to certain undesirable difficulties. For example, prior track structures for model vehicles usually required the tedious manipulation of separate, loose retaining pieces removably interfit with adjacent track sections to hold the latter together, or were of the snap-together type which may require physical forces and manual manipulations beyond the capability of small children. Additionally, prior model roadway constructions were often subject to malfunction under normal conditions of vibration, electrical conductors of adjacent track sections losing contact. Also, prior art track sections often included conductors subject to accumulation of dirt and oxides in use, which often resulted in failure to conduct electricity.

SUMMARY OF THE INVENTION

It is, therefore, an important object of the present invention to provide a highly improved and unique model roadway track construction which overcomes the above-mentioned difficulties, requiring no additional parts for assembly and disassembly, being quickly and easily snap engageable by a simple, fully constrained motion capable of accomplishment by relatively young children without the exertion of undue force or likelihood of damage. The track section of the instant invention further effectively assures continuous electrical contact between adjacent sections over long periods of time, withstanding abusive usage and vibration without loss of intimate electrical contact, and which precludes the interposition of dirt between electrical contacting portions, while effectively cleaning and removing both dirt and oxides by each act of track section assembly.

It is a further object of the present invention to provide a model roadway track construction having the advantageous characteristics mentioned in the preceding paragraph, which is extremely durable and reliable throughout a long useful life, and adapted for efficient mass production in manufacture for effecting economies both in materials and labor.

Other objects of the present invention will become apparent upon reading the following specification and referring to the accompanying drawings, which form a material part of this disclosure.

For the purpose of illustrating the invention, there is shown in the drawing a form which are presently preferred; it being understood, however, that this invention is not limited to the precise arrangements and instrumentalities shown.

BRIEF DESCRIPTION OF THE DRAWINGS

FIG. 1 is a top plan view showing one complete track section of the present invention, and an additional, partial like track section, both sections being interconnectd in operative end-to-end relation.

FIG. 2 is a partial top perspective view showing a pair of track sections of the present invention in adjacent, spaced relation just prior to interfitting engagement.

FIG. 3 is a bottom perspective view showing an end portion of a track section of the present invention.

FIG. 4 is a top plan view showing a pair of track section end portions in an intermediate stage of being connected in their end-to-end operative relation.

FIG. 5 is a partial sectional elevational view taken generally along the line 5—5 of FIG. 1, enlarged for clarity.

DESCRIPTION OF THE PREFERRED EMBODIMENT

Referring now more particularly to the drawings, and specifically to FIG. 1 thereof, a track section is there generally designated 10, and may advantageously be molded, of a suitable plastic by and injection molding procedure or by other known processes. The track 10 includes an elongate, generally flat body 11 extending between generally parallel side edges 12 and 13, and terminating at essentially identical or like end regions 14. In the illustrated embodiment, the track section 10 is for a double or two lane roadway, as for a pair of model vehicles, each lane may be formed with a central guiding formation or groove, as at 15 and 16, which extend in parallelism with each other respectively adjacent to and spaced inwardly from side edges 12 and 13. Similarly, a pair of conductors, or conductive strips 17 and 18 are embedded in the body 11, extending longitudinally thereof adjacent to and on opposite sides of the guide element or groove 15, terminating at opposite end regions 14. A similar pair of elongate conductive elements or strips 19 and 20 are provided in the body 11 extending longitudinally along and on opposite sides of the track groove or guide 16, terminating at opposite end regions 14 of the body.

While the track section 10 is illustrated and described as generally straight, it is appreciated that other suitable configurations may be employed, such as arcuate or curved, wherein the vehicle lane elements 15, 17 and 18, and the vehicle lane elements 16, 19 and 20 would all be similarly arcuate or curved.

While the upper surface of track section body 11 may be generally flat, the body thickness is minimized for reducing weight and cost of materials, consistent with requisite durability and strength, so that the underside of body 11 may be generally hollow, or include hollow formations. Such structure may be seen in the bottom view of FIG. 3, where it will also be apparent that the body 11 includes a pair of longitudinally extending side walls 25 and 26 extending along and depending from respective longitudinal body edges 12 and 13. The guide elements or grooves 15 and 16 are formed by channel-like, depressed body portions 27 and 28 opening upwardly to define the grooves, and having opposite ends opening for communication with like guide elements or grooves of like track sections, as will appear presently in greater detail.

Additionally, the body 11 may be formed with a plurality of relatively narrow, upwardly facing longitudinally extending depressed portions, channels or troughs for respectively receiving and firmly retaining the conductors or metallic strips 17, 18, 19 and 20, as the elongate depressions or channels 29, 30, 31 and 32, respectively.

The end regions 11 of each track section 12 may be essentially identical, having an overall stepped or stagewise edge configuration transversely thereacross. More particularly, each body end region 14 may include a transversely extending laterally and longitudinally intermediate edge portion 35, disposed generally normal to the longitudinal extent of the track section 10 and extending between and terminating at channels 30 and 31 containing respective conductors or strips 18 and 19. Offset longitudinally inwardly from the edge portion 35, and extending generally transversely between and normal to the channels 29 and 30, respectively containing conductors or strips 17 and 18, is a next inner end edge portion 36. An innermost end edge portion 37 is offset longitudinally inwardly of the edge protion 36, extending laterally outwardly from the channel 29 and contained conductor 17 toward the adjacent side wall 25. A projection 38 extends from the longitudinally innermost edge portion 37, generally coplanar with the body 11 longitudinally outwardly thereof, and may taper outwardly to terminate in a transverse end edge protion 39, having projecting from the surface 39 a longitudinal end projection 40 spaced below the upper surface of the projection or lug 38. The projection 38 may have its outer side 41 a generally flush extension of body side wall 25, and may have its inner side 42 generally obliquely longitudinally and laterally outwardly with respect to the body 11.

Laterally on the other side of the intermediate end edge portion 35, there is a longitudinally outwardly offset, transverse end edge protion 45 extending normal to and between the body channels 31 and 32 respectively containing conductors 19 and 20. A longitudinally outermost end edge protion 46 is offset longitudinally outwardly of end edge portion 45, extending laterally outwardly from channel 32 and having its outer side 47 extending obliquely longitudinally inwardly and laterally outwardly to terminate at its inner end in a longitudinally inwardly offset laterally outermost end edge portion 48. The body region adjacent to end edge portion 46 may be considered a longitudinal end projection or lug 49, generally coplanar with the body 11 and having its laterally outer side 47 generally oblique, facing laterally and longitudinally outwardly. A lower end projection or lug 50 may be provided on the outer end surface 46 of projection or lug 49, being spaced below the upper surface of the latter. Also, a lateral projection or wing 51 may extend generally outwardly from the laterally outer side of projection or lug 49, being spaced below the upper surface of the latter, and also being spaced entirely below the laterally outermost edge portion 48.

The conductor strip or member 17, being located in the channel 29, has each opposite end portion extending, as at 55, beyond the adjacent end edge protion 37, so as to lie with one side in facing spaced relation with the oblique wall 42 of projection 38. The other surface of conductor portion 55 may lie in facing engagement with the laterally adjacent portion of body 11, as along end edge 36. Further, the body 11 may be provided with a slot or notch 56 extending inwardly through the end edge 36, longitudinally of and spaced between the guide groove 15 and conductor receiving channel 17. The slot 56 terminates at its inner end spaced inwardly of the innermost edge 37, and combines with the body region between the slot and channel 17 to define thereof a laterally resilient finger 57 in facing engagement and generally coterminus with the extending conductor end portion 55. Thus, the conductor end portion 55 extends beyond the laterally adjacent body portion on one side contiguous to edge portion 37, and is resiliently supported on its other side by the laterally adjacent body portion defining resilient finger 57.

Conductor strip 18 includes opposite end portions 59 each extending beyond the laterally adjacent body portion contiguous to end edge 36, and terminates proximate to the end edge 35, so as to be exposed laterally generally toward projection 38, in the same direction as conductor edge portion 55 is exposed.

The body 11, intermediate the guide groove 16 and conductor strip 19 is provided with a longitudinally inwardly extending output or slot 60, which extends inwardly from the body end portion 45, spaced laterally between the groove 16 and conductor 19 and serves to define of the body material between the slot and conductor a resilient body portion or finger 61. The conductor 19 includes an end portion 62 extending beyond the adjacent end edge 35 and the body material contiguous thereto, and terminating proximate to the free end of finger 61. Thus, the conductor end portion 62 has one side exposed laterally in the same direction as conductor end portions 55 and 59, generally toward the cam surface 42 of projection 38, its other side being resiliently supported by facing engagement with the adjacent finger 61.

Additionally, the conductor strip 20 has its opposite end portions, as at 64, each extending beyond the adjacent end edge portion 45 and the body region contiguous thereto, terminating proximate to the end surface 46 of projection 49. Thus, each conductor strip end portion has one side exposed laterally generally toward the projection 38 and its cam surface 42, its other side being in facing engagement with the laterally adjacent portion of projection 49.

It will now be appreciated that the end portion 14 of each body 11 is generally stepped, as with end edge portions 37, 36, 45 and 46, each extending laterally and being successively in laterally and longitudinally offset relation with respect to each other. Similarly, each of the conductor strip end portions 55, 59, 62 and 64 each extend longitudinally and are laterally and longitudinally offset with respect to each other, combining with the aforementioned end edge proitions to define the stagewise or stepped configuration of the body end portion.

Additionally, each intermediate end edge portion 35 is provided with a pair of generally parallel, longitudinally extending, laterally spaced cuts or slots 65 and 66 terminating at approximately equal distances spaced inwardly from the respective intermediate end edge portion 35. The slots or cuts 65 and 66 combine to define of the body portion therebetween, as at 67, a vertically resiliently deflectable leaf portion. The resiliently deflectable leaf portion 67 is offset from the longitudinal centerline of the body 11, the illustrated embodiment showing the slot 65 generally along the longitudinal centerline of the body and the slot 66 spaced intermediate the slot 65 and conductor strip 59. Of course, this is by way of illustration and without limiting intent. Spaced intermediate the slot 65 and conductor strip 18, adjacent to and spaced inwardly from the intermediate end edge portion 35, is an opening or through hole 68.

A generally flat or plate-like extension or tab 70 is provided on each resilient portion 67, extending longitudinally outwardly from the end edge portion 35 and offset downwardly in a plane parallel to and spaced below that of the resilient portion 67. Each extension or tab 70 is provied on its upper surface with an upstanding boss or lug 71 spaced outwardly from the end edge portion 35 and provided on its longitudinally outer extremity with an inclined plane or bevel 72. The lug or boss 71 is of a size to engage through the opening or hole 68 of a like track section, as will appear more fully hereinafter.

The extension or tab 70 has one portion 73 extending laterally beyond the slot 65, and is there provided with an oblique edge surface 74 facing generally laterally toward the cam surface 42 and longitudinally inwardly of the body 11.

In practice, assembly of a pair of like track sections 10 may proceed by simple endwise inward movement of the track sections toward each other. Specifically, with a pair of like track sections disposed generally coplanar with each other, the projection 49 of each may enter generally between the projection 38 and finger 57 of the other. Further, the oblique surfaces 37 of each projection 49 may ride on the oblique or cam surfaces 42 of each projection 38 upon generally longitudinal and slightly oblique inward movement of track sections toward each other. Simultaneously during this inward track section movement, the oblique complementary cam surfaces or edges 74 of like track section tabs 70 may ride on each other, so that the relative movement of the sections is effectively guided and substantially constrained.

As such inward track section movement reaches completion or home position, each lug 50 of its projection 49 will engage beneath the adjacent end edge surface portion 37, and each conductor strip end portion 53 will simultaneously rub against and in intimate facing engagement with the associated conductor strip end portion 64, to thereby assure intimate electrical contact therebetween. While each projection 49 is substantially rigid in its backing or support for its associated conductor end edge portion 64, the adjacent finger 57 resiliently supports its proximate conductor end edge portion 55, so that a resilient bearing engagement is maintained between the facing conductor strip end portions 55 and 64. Simultaneously, each conductor strip end portion 59 rubs against and resiliently bears on its adjacent facing conductor strip end portion 62, the latter being resiliently maintained in intimate electrical contact with the former by the resilience of fingers 61.

Coplanarity between the track sections 10 in their end-to-end engagement is maintained by interfitting engagement of wings 51 beneath projections 38, and of lugs 40 beneath end edge portions 48.

During the above-described movement of track sections into end-to-end engagement, an intermediate position of such movement being best seen in FIG. 4, the extensions or tabs 70 are each engaged beneath the adjacent opposed apertured body portion 76. Further, the lugs 71, by their bevel surfaces 72 ride on the edge portion 35 and are thereby deflected downwardly beneath the body portion 76, until the lugs 71 snap upward into respective openings or holes 68. In this condition, by the generally vertical edge engagement of lugs 71 in respective holes 68, the track sections are effectively and positively maintained in their end-to-end connected relation. Such retention is effective against substantially all conditions of use, while permitting of quick and easy disassembly, as desired. That is, as each lug 71 in the assembled condition is presently upwardly through its receiving opening 68, it is only necessary to depress the lugs downwardly against the resilient force of leaves 67, thereby permitting endwise withdrawal or separation of the track sections.

The fully connected condition of track sections is shown in FIG. 1, where it will be apparent that the guideways or grooves 15 and 16 of adjacent sections are located in alignment with respective guideways 16 and 15 of a like section. Similarly, electrical contact and mechanical juxtaposition of associated conductor strips is assured for electrical continuity and proper contact with vehicle shoes.

While the foregoing description has assumed the inclusion of conductor elements in the track sections for electrically powered vehicles, it is of course apparent that the improvements of the instant track construction may be utilized without conductors, as for non-electrically powered vehicles. In the absence of conductors, the extending body end portions, such as fingers 57 and 61 may be considered as resilient engaging means or fingers, each having a lateral surface exposed in one direction for intimate contact and mechanical juxtaposition with a complementary surface of a like track construction. Also, it will be appreciated that the interfitting retaining or locking means described hereinbefore as a lug 71 on extension 70 and through hole 68 on body portion 76 may assume other releasable interfitting locking formations without departing from the instant invention. Obviously, the elements may be reversed to provide a lug on body part 76 and receiver or opening in extension 70, and also the illustrated opening 68 may be a recess rather than a through hole, so as to be concealed from above while permitting lug removal by manual deflection of the body portion 67.

In all events, the track sections of the present invention are substantially automatically interengaging by reason of the automatic guiding and aligning effected by the interacting cam surfaces. This highly automatic interfitting of track section ends permits of quick and easy assembly by even relatively young persons lacking developed skill and coordination. In addition to alignment laterally of the track sections being highaly automatically effected by interaction of the cam surfaces, relative vertical alignment or coplanarity of adjacent track sections is achieved by interfitting engagement of end lugs with receiving regions, as of lugs 40 beneath end portions 48. If desired, end lugs may be beveled, say the upper end edges of lugs 40 and 50 to facilitate their engagement into interfitting relation beneath end edge portions 48.

However, the interfitting engagement of lugs 40 and 50 beneath respective end edge portions further insures relatively smooth transition of roadway at the junctures of track sections by reason of the relatively positive interlock afforded. This smooth continuity of roadway surface is achieved while permitting of change in roadway elevation by flexibility of track sections. That is, the instant construction enables track sections to be of more precisely controlled thickness to afford desirable flexure without discontinuity of surface smoothness, and while effecting savings in weight and materials.

It will also be appreciated that the hereinbefore described interfitting relationship is achieved with but negligible endwise pressure between connected sections, so that internal stresses are very considerably reduced. Only moderate lateral pressures are required sufficient to insure proper electrical continuity and without likelihood to effect track damage.

From the foregoing, it is seen that the present invention provides a roadway track construction which is quickly and easily engageable and disengageable with rspect to a like roadway track section, without separate parts, assuring long lived and reliable operation under substantially all conditions of use, automatically maintainining electricl contacts clean of dirt and oxide, and which otherwise fully accomplishes its intended objects.

The present invention may be embodied in other specific forms without departing from the spirit or essential attributes thereof and, accordingly, reference should be made to the appended claims, rather than to the foregoing specification as indicating the scope of the invention.

What is claimed is:

1. A track section for a model vehicle, said track section comprising a generally flat elongate body having an upper surface for movement therealong of vehicles, an elongate conductor extending longitudinally along said body and exposed therefrom for contact with a moving vehicle, each end portion of said conductor extending longitudinally of said body and beyond the laterally adjacent portion of said body on one side of the conductor end portion to expose the latter in one lateral direction, and a projection extending from each longitudinal end of said body, each projection having a cam surface, one of said cam surfaces facing in a laterally outward direction toward a side edge of said body and the other of said cam surfaces facing in a laterally inward direction from said last-mentioned side edge, one of said projections having said elongate conductor disposed along a lateral surface of said one projection which is opposite the cam surface of the said one projection, the other of said projections having said elongate conductor disposed in a facing and spaced relationship to the cam surface of said other projection, whereby said track section is engageable in end-to-end relation with an additional essentially identical track section so that the cam surfaces of said first mentioned and additional track sections ride on each other to shift the laterally exposed conductor end portions into side-by-side facing engagement for intimate electrical contact and mechanical juxtaposition.

2. A track section according to claim 1, the laterally adjacent body portion on the other side of one of of said conductor end portions being resiliently deflectable in the opposite lateral direction, for resilient bearing engagement of said exposed conductor end portions whereby said last-mentioned body portion deflects from its normal position to resiliently engage said exposed conductor end portions.

3. A track section according to claim 2, said laterally adjacent body portion on the other side of each conductor end portion comprising a resiliently deflectable finger.

4. A track section according to claim 1, in combination with resilient snap lock elements on each body end for relative interfitting engagement with snap lock elements of like track sections.

5. A track section according to claim 4, said snap lock elements comprising a downwardly deflectable longitudinal extension, and a lug on one of said extensions and body, the other of said body and extension having a hole, whereby the lug of one track section is removably snap engageable in the hole of a like track section.

6. A track section according to claim 5, in combination with a complementary cam at each end of said body facing obliquely inwardly and in said one lateral direction, whereby the complementary cam of said first-mentioned section rides on the complementary cam of a like track section to effectively constrain said first-mentioned and like track sections into said position of electrical contact and mechanical juxtaposition.

7. A track section according to claim 6, said complementary cams being on said extensions.

8. A track section according to claim 7, said complementary cams comprising edge surfaces of said extensions.

9. A track section according to claim 7, said lugs being beveled to deflect the associated extensions downwardly for snap engagement in the holes of the like track sections and upward presentation therethrough.

10. A track section according to claim 1, in combination with an additional elongate conductor extending longitudinally along said body in parallel spaced relation with said first-mentioned conductor and presented from said body for contact with a moving vehicle, each end portion of said additional conductor extending beyond the laterally adjacent portion of said body on one side of the additional conductor end portion to expose the latter in said one lateral direction, whereby said additional conductor is movable into intimate electrical contact and mechanical justaposition with a corresponding additional conductor of a like track section.

11. A track section for model vehicles, said track section comprising a generally flat elongate body having an upper surface for movement therealong of vehicles, engaging means including a body part extending longitudinally of said body at each end thereof beyond the laterally adjacent portion of said body to expose one surface of the body part in one lateral direction at each respective end, said engaging means further including a resilient finger at each end of the body formed by a slot extending longitudinally to expose a surface of said resilient finger in said one lateral direction at each respective end of said body, said one lateral direction at one longitudinal end of said body being opposite to the one lateral direction at the other longitudinal end of said body, a projection extending from each longitudinal end of said body, each projection having a cam surface, one of said cam surfaces facing laterally outward toward a side edge of said body and the other of said cam surfaces facing laterally inward from said last-mentioned side edge, whereby said track section is engageable in end-to-end relation with an additional essentially identical track section so that the cam surfaces of said first mentioned and additional track sections ride on each other to shift the laterally exposed surfaces of said body part and said resilient finger into side-by-side facing engagement for intimate contact and mechanical juxtaposition.

12. A track section according to claim 11, said finger being resiliently deflectable from its normal position for resilient bearing engagement of its laterally exposed surface.

13. A track section according to claim 12, in combination with resilient snap lock elements on each body end for relative interfitting engagement with snap lock elements of like track sections.

14. A track section according to claim 13, said snap lock elements comprising a downwardly deflectable longitudinal extension, and a lug on one of said extension and body, the other of said extension and body having an opening, whereby the lug of one track section is removably snap engageable in the opening of a like track section.

15. A track section for model vehicles comprising:

a generally flat elongate body having an upper surface for movement therealong of vehicles;

said track section having a plurality of projections extending longitudinally outward from each end of said body;

each projection having a lateral surface generally parallel to the lengthwise dimension of said track;

the major face of each said lateral surface at one end of said body facing in a direction toward a single side edge of said body and the major face of each said lateral surface at the other end of said body facing in a direction toward the other side edge of said body;

the lateral surface of each projection extending longitudinally further from said body than the laterally adjacent portion of said body whereby said projections are arranged in a stepped relation;

locking means on each end of said body for locking engagement with locking means of like track sections whereby said track section is engageable in end-to-end relation with an additional essential identical track section so that said stepped projections interfit with mating stepped projections of said additional track section.

16. A track section according to claim 15 including elongate conductors extending longitudinally along said body and exposed therefrom for contact with a moving vehicle, each end portion of each conductor extending beyond the laterally adjacent portion of said body on one side of the conductor end portion to expose the conductor in one lateral direction, the other side of each conductor end portion being adjacent to and facing one of said lateral surfaces.

17. A track section according to claim 15 including at least four projections.

18. A track section according to claim 17 including elongate conductors extending longitudinally along said body and exposed therefrom for contact with a moving vehicle, each end portion of each conductor extending beyond the laterally adjacent portion of said body on one side of the conductor end portion to expose the conductor in one lateral direction, the other side of each conductor end portion being adjacent to and facing one of said lateral surfaces.

19. A track section according to claim 17 wherein the projection extending furthest from each end of said body has a cam surface on the opposite side from the lateral surface of said last-mentioned projection, and each cam surface is angled relative to the side edges of the body and faces laterally outward.

* * * * *